US005197461A

United States Patent [19]

Petajan et al.

[11] Patent Number: 5,197,461

[45] Date of Patent: Mar. 30, 1993

[54] POWER ADJUSTABLE ORTHOPEDIC PILLOW

[75] Inventors: Jack H. Petajan; Stephen R. Topaz, both of Salt Lake City, Utah

[73] Assignee: University of Utah Research Foundation, Salt Lake City, Utah

[21] Appl. No.: 743,730

[22] Filed: Aug. 12, 1991

[51] Int. Cl.[5] ..... A61F 5/34

[52] U.S. Cl. ..... 128/118.1; 128/DIG. 20

[58] Field of Search ..... 128/25 R, 25 B, 26, 128/40, 118.1, 677, 680, DIG. 20

[56] References Cited

U.S. PATENT DOCUMENTS

| | | | |
|---|---|---|---|
| 3,492,988 | 2/1970 | De Mare . | |
| 3,760,801 | 9/1973 | Borgeas | 128/25 R |
| 3,937,215 | 2/1976 | Barthlowe | 128/26 |
| 4,003,374 | 1/1977 | Mizrachy . | |
| 4,274,399 | 6/1981 | Mummert | 128/26 |
| 4,596,240 | 6/1986 | Takahashi et al. . | |
| 4,614,180 | 9/1986 | Gardner et al. | 128/25 B |
| 4,619,250 | 10/1986 | Hasegawa . | |
| 4,671,258 | 6/1987 | Barthlome . | |
| 4,981,131 | 1/1991 | Hazard | 128/25 R |
| 5,020,515 | 6/1991 | Mann et al. | 128/26 |
| 5,029,589 | 7/1991 | Kato | 128/677 |
| 5,033,457 | 7/1991 | Bonutti | 128/25 R |
| 5,099,851 | 3/1992 | Hata et al. | 128/680 |

*Primary Examiner*—Richard J. Apley

*Assistant Examiner*—Lynne A. Reichard

*Attorney, Agent, or Firm*—Thorpe, North & Western

[57] ABSTRACT

This invention provides a pressure sensitive inflatable orthopedic pillow for therapy which comprises an inflatable bladder, an air switch in fluid communication with the bladder via a gas feedline, and an air supply which provides a constant stream of air to the air switch. The air switch includes an atmospheric pressure inlet, a connector tube through which overflow air is returned from the bladder to the air switch, and an exhaust outlet. The inflatable bladder is cyclically inflated and deflated without outside control means, the cycle beginning with inflation of the bladder by directing a stream of air provided by the air supply through the air switch into the bladder until the bladder is inflated. The cycle ends with deflation of the bladder by directing an overflow stream of air from the inflated bladder into return conduit to be returned to the air switch, whereupon the stream of air provided by the air supply is diverted into the exhaust outlet by the overflow stream of air and by air thereafter forced out of the bladder by negative air pressure. Alternatively, an electrically or mechanically controlled pressure sensor measures pressure within the inflatable bladder. Upon reaching a predetermined pressure level, the pressure sensor sends a signal to a valve, which reverses the stream of air, thereby allowing the bladder to deflate.

17 Claims, 4 Drawing Sheets

POWER ADJUSTABLE ORTHOPEDIC PILLOW

BACKGROUND

1. Field

This invention relates generally to orthopedic devices for assisting in patient exercise and more specifically to an inflatable oscillating pillow for moving body extremities which a patient would otherwise be unable to move.

2. Prior art

Incapacitation of body parts is among the results of any number of maladies, for example diseases of the central nervous system. Cerebrovascular ailments, cerebral injury, cerebral palsy, spinal cord damage, as well as disfunctions of the peripheral nervous system, joints, muscles and tendons are only a few of the causes of incapacitation of body parts.

A great many devices and apparatus are known whereby extremity functions lost to such disease or injury may be partially or completely regained. In particular, devices are known in which a pillow or similar inflatable bag is disposed below the body part and oscillated by mechanical driving means to cause the incapacitated body part to move. These devices have been found to be somewhat effective because gentle passive stretch of incapacitated muscles reduces resistance to increased stretch and also quiets abnormal reflex activity.

For example, U.S. Pat. No. 4,671,258, issued to Barthlome, discloses a device which utilizes a spring to bias the inflatable pillow in a retracted condition, with the pillow responding upon inflation to extend. U.S. Pat. No. 4,003,374, issued to Mizrachy, utilizes a bellows-type drive system which is powered by a fluid source. A rigid plate is also included in the '374 patent, which represents an older concept in exercise devices. Such a rigid plate has the distinct disadvantage of being incapable of conforming to the body part to be moved. U.S. Pat. No. 3,492,988, issued to DeMare, has the same disadvantage as the '374 patent.

U.S. Pat. No. 4,619,250, issued to Hasegawa, and U.S. Pat. No. 4,596,240, issued to Takahashi, are adapted specifically for hand therapy and include mechanical drive means. In particular, the '240 patent requires the use of a mechanical valve to cycle the inflation/deflation of the pillow. Similarly, the '250 patent provides for a complex mechanical drive system which can easily break, is inordinately expensive, and is difficult to repair.

Furthermore, none of the prior art includes an oscillating pillow wherein the oscillation cycles are responsive to the patient's movements. Rather, each prior art patent discloses an oscillating mechanism which is time controlled, i.e. each inflation and deflation of the cycle is set to a specified time. Such an arrangement has the undesired effect of forcing the limb to be exercised to move in a certain manner. This may prove harmful to the patient when experiencing spasms caused by cerebral or muscular disorders or even coughing. An oscillating pillow system, therefore, would advantageously be provided with a switch or similar mechanism which regulates the oscillations according to pressure variations within the system, such as those caused by a patient's spasms, rather than by time actuated means.

Therefore, there exists in the art a legitimate need for a system which provides an oscillating pillow wherein the oscillations are provided by a pressure sensitive simplified, inexpensive, easily manufactured valve or switch. Further, there exists a need for an oscillating pillow which is specifically designed to accommodate each individual body part.

BRIEF SUMMARY AND OBJECTS OF THE INVENTION

Accordingly, a principal objective of the present invention is the provision of an inflatable, oscillating pillow for physical therapy in which the oscillations are provided by a pressure sensitive fluidic circuit, including a constant air supply and an air switch to provide varying pressure to the pillow.

Another principal objective of this invention is to provide an oscillating pillow which is shaped to conform to the body part upon which the therapy is to be accomplished.

Still another major objective is the provision of an oscillating pillow having no moving parts other than an inflatable, oscillating bladder.

A further important object is the provision of a fluidic circuit for cyclically inflating and deflating an orthopedic pillow used to exercise incapacitated body parts.

Another important objective is to provide an inflatable/deflatable orthopedic pillow which is simple to construct, inexpensive to manufacture and operate, non mechanical, durable, and which requires little or no maintenance and is self-operating once a connected air supply is actuated.

These and other objectives of the invention are realized in a preferred embodiment of a power adjustable orthopedic pillow comprising an inflatable bladder constructed of a non elastic or a semielastic material, switching means in fluid communication with the bladder, and an air supply for providing a constant stream of air to the switching means. The switching means preferably is an air switch which comprises an inflation passage which connects the inflatable bladder thereto such that the air switch and inflatable bladder are in fluid communication, an atmospheric pressure inlet, a return conduit through which overflow air is returned from the inflatable bladder to the air switch, and an exhaust outlet. The preferred inflatable bladder is thereby cyclically inflated and deflated without outside control means or moving components.

A second preferred embodiment of the switching means comprises an electrically controlled pressure sensor coupled to and controlling an electrically operated valve which switches the direction of the stream of gas upon receiving an electrical signal from the pressure sensor. Still another embodiment of the switching means includes a mechanically controlled pressure sensor which similarly is coupled to and controls a mechanically operated valve.

The cycle begins with inflation of the bladder by directing or biasing a stream of air from the air supply through the switching means and into the bladder until the bladder is completely inflated. When using the air switch, negative air pressure produced by a Venturi effect forces outside air into the atmospheric pressure inlet to urge or deflect the stream of air from the air supply into the inflation passage. Overflow air from the inflated bladder is directed into a return conduit having a pressure regulated valve for selectively opening at a given pressure to return air from the bladder to the air switch. The return conduit is disposed so as to direct the overflow stream of air from the inflated bladder into the stream of air provided by the air supply at a right angle, thus diverting or shifting the direction of flow of the stream of air provided by the air supply into an exhaust outlet and away from the inflation passageway leading to the pillow.

Negative air pressure created by a Venturi effect at the exhaust outlet tends to pull air out of the bladder in a reverse direction through the inflation passage and into the exhaust outlet, thereby deflating the bladder. Upon complete deflation of the bladder, the deflecting force of the overflow air subsides, and negative air pressure again arises at the atmospheric pressure inlet, generating an inflow of air which again causes deflection of the stream of air provided by the air supply into the inflation passageway to fill the bladder. This process is automatically repeated as long as a constant stream of air is provided by the air supply.

On skilled in the art will recognize that sudden pressure variations within the bladder, such as those caused by spasms and coughing, if great enough, can activate the regulating valve in the return conduit and cause the air switch or other switching means to reverse the direction of the constant stream of air. In other words, the patient's bodily reflexes are capable of stopping and reversing the cycle before the bladder is completely full or completely empty during any given cycle. The feature provides protection of the patient against injury during exercise therapy.

DESCRIPTION OF THE DRAWINGS

The above and other objects, features and advantages of the invention will become apparent from a consideration of the following detailed description presented in connection with the accompanying drawings in which.

DETAILED DESCRIPTION OF THE PREFERRED EMBODIMENT

Figure 1:
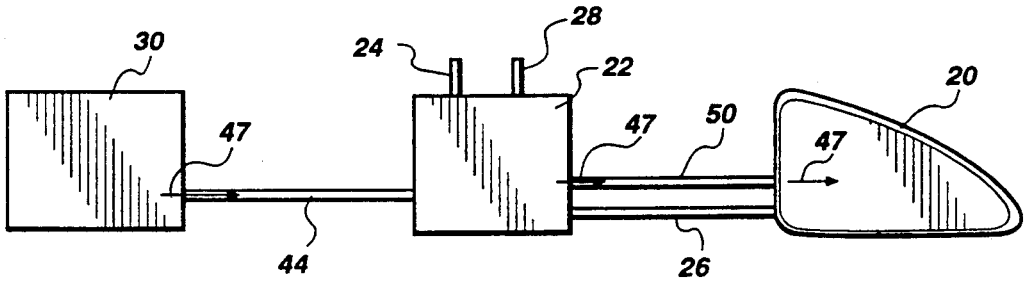
FIG. 1 is a schematic representation of the preferred embodiment of the present invention.

Reference is now made to the drawings wherein like numerals are used to denote like components throughout. The preferred oscillating orthopedic pillow of the present invention comprises generally an inflatable bladder 20; an air switch 22 in fluid communication with the bladder 20 through an inflation feedline 50, the air switch 22 including an atmospheric pressure inlet 24, a return conduit or connector tube 26 through which overflow air is returned from the bladder 20 to the air switch 22, and an exhaust outlet 28; and an air supply 30 for providing a constant stream of air to the air switch 22. Each of these components will be described hereafter in greater detail.

As shown in FIGS. 2–8, a variety of different inflatable bladders 20 fall within the purview of this invention. For example, FIGS. 2A and 2B illustrate a generally wedge shaped bladder 20 which is designed for use with an arm or leg. In this embodiment, the distal portion of the arm or leg to be exercised is placed near the edge of the bladder 20 which experiences the greatest volumetric change during inflation and deflation.

Figure 2A:
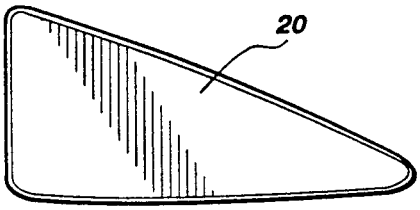
FIG. 2A is an isolated elevational view of a preferred bladder, according to the present invention, specifically designed for use with an arm or leg, shown inflated.
Figure 2B:
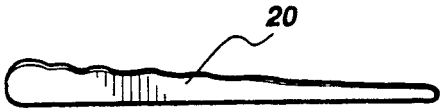
FIG. 2B is an isolated view of the bladder of FIG. 2A, shown deflated.
Figure 3A:
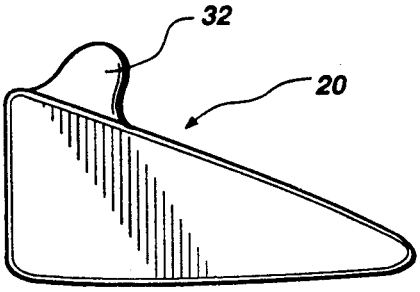
FIG. 3A is an isolated elevational view similar to FIG. 2A except for a separate inflatable bulb designed to exercise a patient's wrist, shown inflated.
Figure 3B:
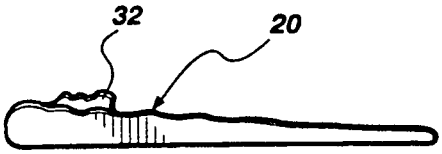
FIG. 3B is an isolated elevational view of the bladder of FIG. 3A shown deflated.

A modification of the inflatable bladder 20 shown in FIGS. 2A and 2B are illustrated in FIGS. 3A and 3B. This particular embodiment shows an inflatable bulb 32 which is placed beneath the hand of the patient. Thus, bladder 20 shown in FIGS. 3A and 3B is designed specifically for use with the wrist and hand. As indicated, placing the hand above the bulb 32 causes the wrist to flex upwardly upon inflation of the bladder 20.

Figure 4A:
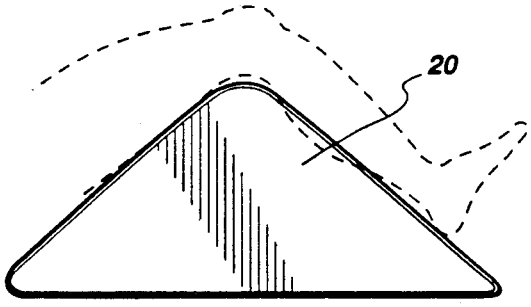
FIG. 4A is an isolated elevational view of another bladder according to the present invention, specifically designed for use with a patient's knee.
Figure 4B:
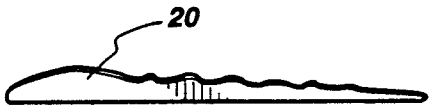
FIG. 4B is an isolated elevational view of the bladder of FIG. 4A shown deflated.

FIGS. 4A and 4B illustrate yet another preferred embodiment of inflatable bladder 20, this being specifically designed for use with the patient's knee. The patient's knee is placed over the deflated bladder 20 as shown in FIG. 4B such that when the bladder 20 is inflated, as shown in FIG. 4A, the knee will rise, thus providing flexure to that joint as illustrated in broken lines.

Figure 5A:
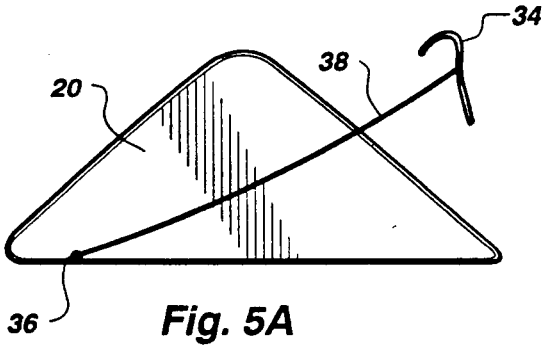
FIG. 5A is a view similar to FIG. 4A, further illustrating an attachment piece for the foot which causes rotation of the foot and ankle upon inflation of the bladder, shown inflated.
Figure 5B:
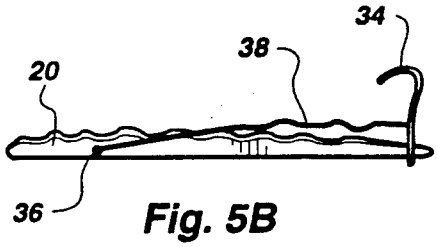
FIG. 5B is an isolated elevational view of the bladder of FIG. 5A, shown deflated.

FIGS. 5A and 5B are variations of the embodiment of FIGS. 4A and 4B. These figures show the addition of a foot harness 34 which is attached at an attachment point 36 on bladder 20 by a non-flexing cord 38. In use, the foot harness 34 is strapped or otherwise attached to the foot of the patient whose knee is to be exercised by the present invention. The cord 38 is sized so as to be somewhat taut when the bladder 20 is in a deflated state as shown in FIG. 5B. Thus, when bladder 20 is inflated as shown in FIG. 5A, and the knee correspondingly rises, the foot of the patient attached to the harness 34 is simultaneously turned outwardly to provide additional flexure.

Figure 6A:
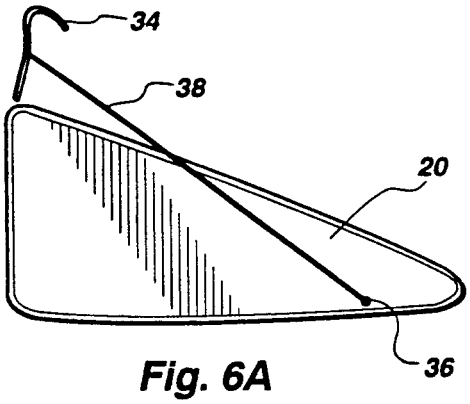
FIG. 6A is an isolated elevational view of a bladder similar to that of FIG. 2A shown with the foot attachment piece of FIG. 5A to cause rotational movement of the foot upon inflation of the bladder, shown inflated.
Figure 6B:
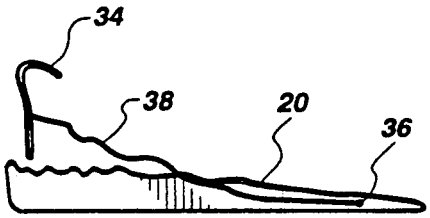
FIG. 6B is an elevational view of the bladder and foot attachment of FIG. 6A, shown deflated.

Similarly, FIGS. 6A and 6B illustrate use of the foot harness 34 with the inflatable bladder 20 shown in FIGS. 2A and 2B. In this embodiment, the foot is again strapped or otherwise attached to the foot harness 34, the foot harness being attached to the bladder 20 at an attachment point 36 by cord 38. As the bladder 20 is inflated, and the foot rises, the foot is forced outwardly to provide rotational as well as elevational flexure.

Figure 7A:
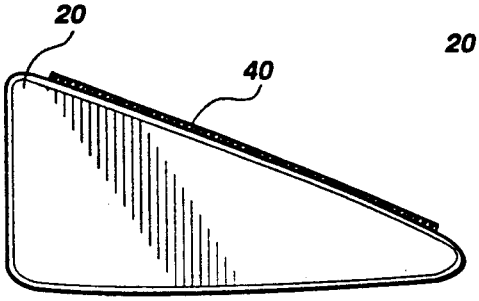
FIG. 7A is an isolated elevational view of the bladder of FIG. 2A further showing means for attaching the patient's leg or arm to the bladder, shown inflated.
Figure 7B:
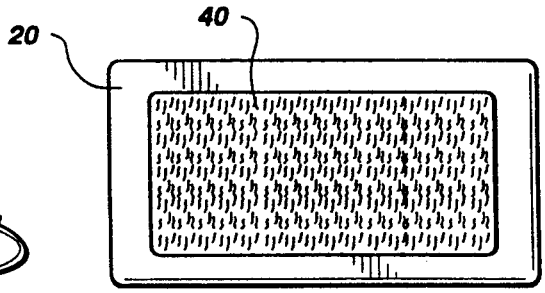
FIG. 7B is a plan view of the bladder of FIG. 7A.

It may also be desirable to provide the bladder 20 with means for preventing slippage of the extremity to be exercised along the bladder surface 20 during the inflation/deflation cycles. One method is shown in FIGS. 7A and 7B, which illustrate one side of a VELCRO TM fastener 40 secured to the top face of the bladder 20. In use, an opposing, interlocking VELCRO fastener, not shown, is strapped or otherwise fastened to the patient's extremity to be exercised. Placement of this corresponding VELCRO fastener onto Velcro TM fastener 40 prevents movement of the patient's extremity relative to the bladder 20. It will be recognized that other types of fasteners other than VELCRO may be used to prevent the slippage mentioned, all of which fall within the limitations of the present invention.

Figure 8A:
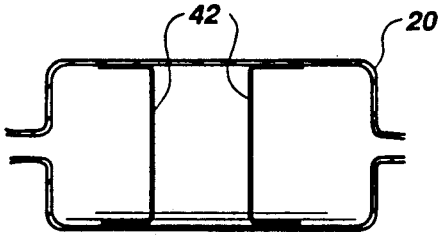
FIG. 8A is an isolated cutaway elevational view of a preferred bladder showing septa to assist the bladder in maintaining the desired shape upon inflation, shown inflated.
Figure 8B:
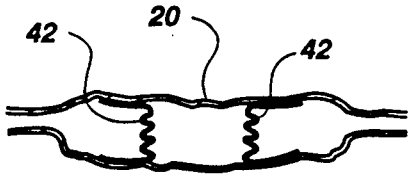
FIG. 8B is a isolated cutaway elevational view of the bladder of FIG. 8A shown deflated.

As best illustrated in FIGS. 8A and 8B, each inflatable bladder 20 may be provided with reinforcing septa to assist in maintaining the desired shape of the bladder 20. Importantly, each septum 42 must be made of a non-elastic, non-expanding material and each is attached, as shown, to opposing walls of the bladder 20. Preferably, bladder 20 is constructed of a material which is flexible, and yet semielastic so that desired shapes may be substantially maintained upon inflation.

Referring now to FIG. 1, a schematic representation of the invention, as presently preferred, is illustrated. In principle, the invention operates as follows:

The inflation or gas feedline 50 is coupled in any well-known manner to the properly shaped inflatable bladder 20 which exercises the desired body extremity. After placing the extremity over the bladder 20, a stream of gas 47 from the air supply 30 and supply line 44 is directed by a switching system 22 through a gas feedline 50 into the bladder 20 to generate a predetermined, threshold pressure therein. Preferably, the predetermined pressure does not exceed 30 millimeters of mercury. Advantageously, the predetermined pressure within the bladder is based upon the combined pressure effects of the stream of gas, the weight of the patient's limb, and active movement of the patient's limb against the bladder during inflation. As shown, the constant stream 47 of gas, preferably air, is provided by the air supply 30. Once the predetermined threshold pressure is reached, the direction of the stream of gas is automatically reversed, thus exhausting the gas from the inflatable bladder 20 through exhaust outlet 28, without respect to predetermined cycles of time or the actual extent of inflation. For example, a spasm may occur when the bladder is only halfway inflated which may drive bladder pressure to the threshold limit. At this point, deflation would commence.

Air supply 30 is standard in the medical industry and may be provided by a number of different well-known apparatus. For example, air supply 30 may be an air compressor. Alternatively, a tank of compressed air may be used. The air supply 30 provides a constant stream 47 of air at regulated pressure through a passageway 44 into the air switch 22.

As shown, pressure sensitive switching means 22 is coupled in fluid communication with the gas feedline 50, whereby the inflow direction of the stream of gas is switched to exhaust when the predetermined pressure is sensed. The switching means 22 preferably includes the air switch, but may instead include an electrically or mechanically controlled pressure sensor coupled to a corresponding electrically or mechanically operated valve which switches between inflow and exhaust of the stream of gas upon receiving an appropriate signal from the pressure sensor.

Figure 9:
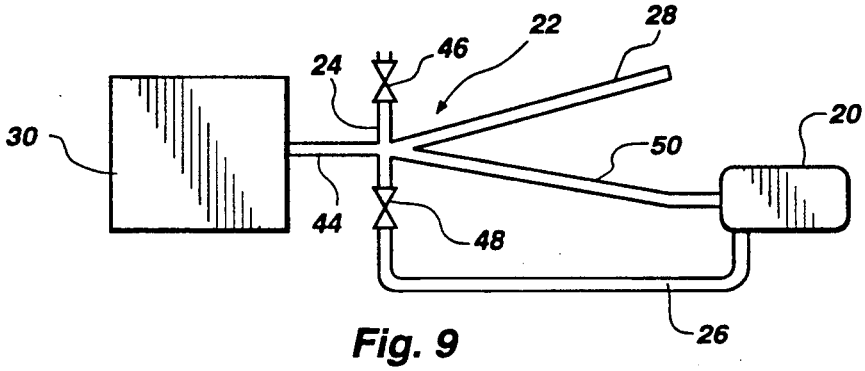
FIG. 9 is a schematic representation of the air switch, according to the principles of the present invention.

Referring now to FIG. 9, a preferred representation of an air switch 22 is provided. As shown, air switch 22 comprises an atmospheric pressure inlet 24, an inflation tube 50, a connector tube or return conduit 26, and an exhaust outlet 28. Atmospheric pressure inlet 24 and the connector tube 26 are each advantageously provided with a standard flow restrictor 46 and 48, respectively, which effectively control the flow rate of air allowed to pass therethrough and thereby respond to pressure changes within the flow line. Preferably, flow restrictors 46 and 48 are adjustable so as to allow greater or lesser amounts of air to flow therethrough, as desired, to regulate the speed of the inflation/deflation cycles. Other forms of pressure controlled valves could also be applied as items 46 and 48.

Figure 10A:
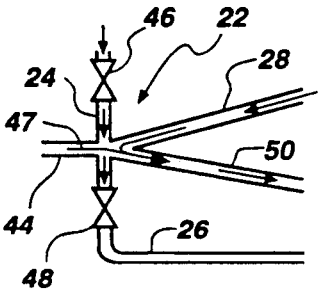
FIG. 10A is a partial view of FIG. 9 illustrating the operation of the air switch as the bladder is inflated.
Figure 10B:
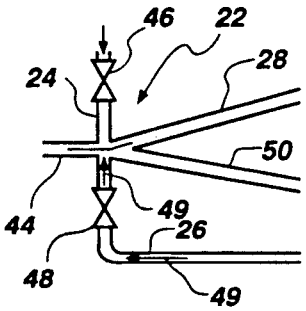
FIG. 10B is a partial view similar to FIG. 10A except illustrating the switching of passageways by the air stream upon filling of the inflatable bladder.
Figure 10C:
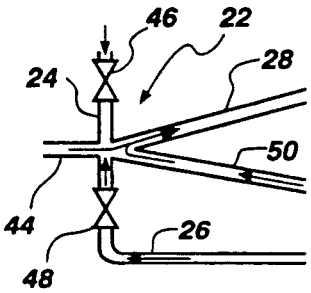
FIG. 10C is a partial view similar to FIG. 10A except showing the operation of the air switch as the bladder deflates.

FIGS. 10A through 10C illustrate the direction of flow of air through the air switch 22 at different points during the inflation/deflation cycle. FIG. 10A illustrates the flow of air as the bladder 20 is inflated. As shown, air 47 is received from the air supply 30 through passageway 44 to be shifted or diverted toward the gas feedline 50 by both a negative air pressure in the connector tube 26 and a positive air pressure developed by Venturi effect which causes air flow through atmospheric pressure inlet 24 and exhaust outlet 28. The gas feedline 50 is of course coupled to the inflatable bladder 20.

Once the bladder 20 is filled with air, a switch point comprising the predetermined threshold pressure is reached. The effects of this switch point are shown in FIG. 10B. When this pressure is reached, typically when the bladder 20 becomes completely filled with air 49, overflow air is directed into the connector tube 26 to be returned to the air switch 22, the overflow stream of air intersecting the stream of air 47 from the air supply 30 being fed through a feedline 44, thereby diverting the air stream 44 from the air supply 30 into the exhaust outlet 28.

Without a supply of air being supplied through gas feedline 50 to fill inflatable bladder 20, air begins to be forced out of the bladder both through connector tube 26 and gas feedline 50 because of Venturi suction. See FIG. 10C. In this manner, the inflatable bladder 20 is deflated, whereupon the pressures reverse and the inflation/deflation cycle begins anew. Thus, the inflatable bladder 20 is cyclically inflated and deflated without outside control means. This cycle begins with inflation of the bladder and ends with deflation of the bladder.

Figure 11:
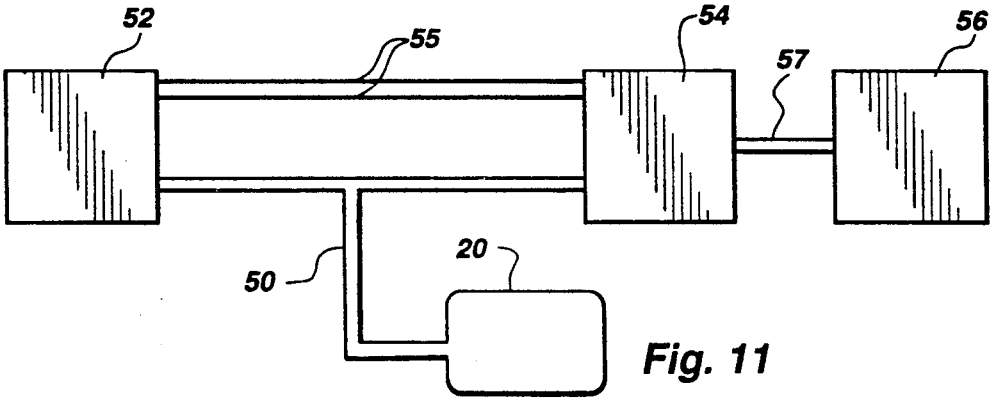
FIG. 11 is a schematic representation of another preferred embodiment of the present invention wherein an electric pressure switch causes inflation and deflation of the bladder.

Although an air switch 22, as explained above, is preferred for use in regulating the inflation and deflation of the bladder 20, it is to be recognized that other forms of switching means are contemplated. For example, FIG. 11 shows a diagrammatic representation of a second embodiment of the present invention in which the air supply 30 is powered by an electric pump 52. An electric pressure sensor 54 coupled to the electric pump 52 by appropriate wires 55 measures the pressure within the inflatable bladder 20 and at appropriate detection of the threshold pressure, causes reversal of the direction of the electric pump 52. An appropriate valve, not shown, contained within the pump 52, controls the direction of the gas flow. This system is, of course, powered by electrical power means 56 coupled to the electric pressure sensor 54 by appropriate wires 57, and is preferably a standard household outlet. The electric pump 52, the electric pressure switch 54, and the electric power means 56 are well known in the art and thus will not be described in detail herein.

Figure 12:
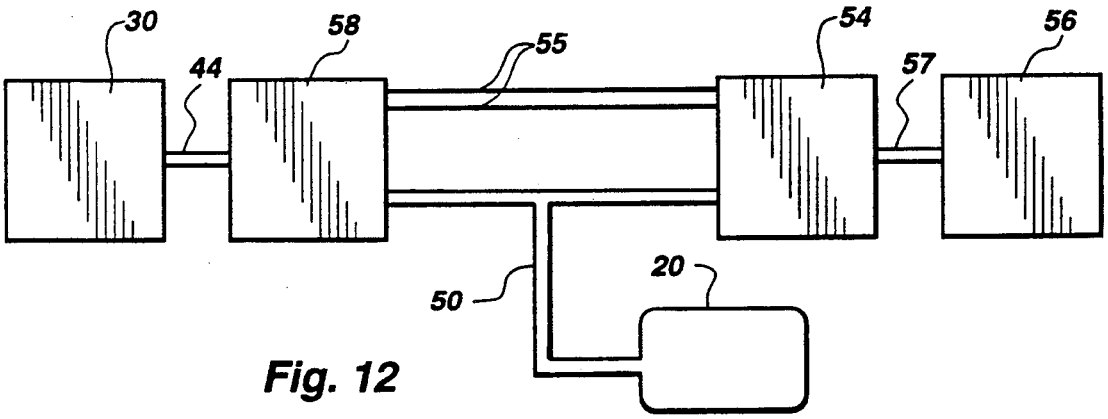
FIG. 12 is a schematic representation of still another preferred embodiment wherein an electric pressure switch actuates inflation and deflation of the bladder.

FIG. 12 shows another embodiment of the preferred invention in which a solenoid valve 58 is used to control the air supply 30. An electrical pressure sensor 54, identical to that shown in FIG. 11, detects the threshold pressure inside inflatable bladder 20 and opens and closes the solenoid valve 58 accordingly. Electrical power means 56, as in the embodiment of FIG. 11, provides power to the system. All other components are as those described above in connection with FIGS. 9 and 11.

Figure 13:
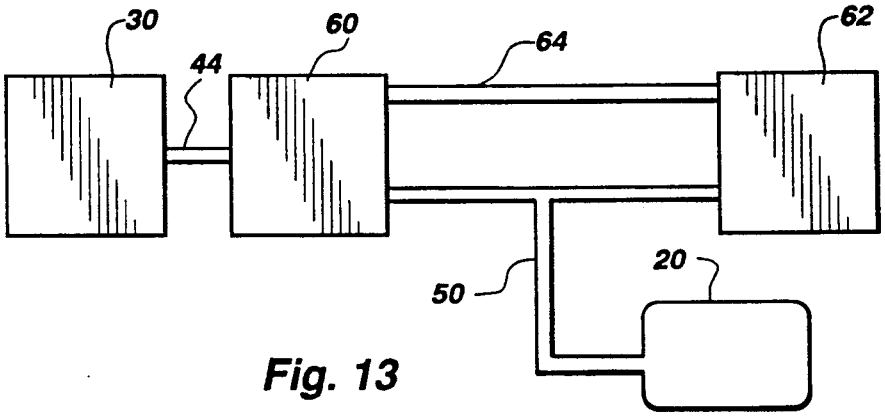
FIG. 13 is still another schematic representation of another embodiment of the present invention wherein a mechanical pressure actuator causes inflation and deflation of the bladder.

FIG. 13 shows still another preferred embodiment of the present invention. The system of this embodiment makes use of a mechanical valve 60 coupled to the air supply 30 by an appropriate feedline 44. A mechanical pressure sensor 62 mechanically measures the pressure in inflatable bladder 20 and regulates the mechanical valve 60 by means of a standard mechanical link 64.

Figure 14:
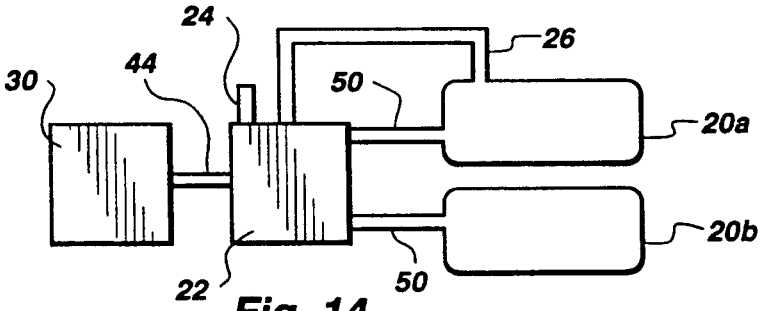
FIG. 14 is a schematic representation similar to FIG. 1, except showing two inflatable bladders, according to a preferred embodiment of the invention.

In yet another embodiment of the preferred invention, illustrated in FIG. 14, dual inflatable bladders 20A and 20B may be used simultaneously. Herein, the air stream provided by air supply 30 fills first one inflatable bladder 20A until it is full or the threshold pressure is reached. The air switch 22 then changes the direction of the air stream, as explained above, while the first bladder 20A deflates. However, rather than exhausting the stream of air through an exhaust outlet, as explained above, the stream of air is diverted to fill the second bladder 20B while the first bladder 20A deflates. In this manner, the air supply 30 is continually filling one of the inflatable bladders 20A while the other inflatable bladder 20B is deflating. This embodiment is desirable when more than one body extremity is to be exercised, e.g. two legs.

Figure 15:
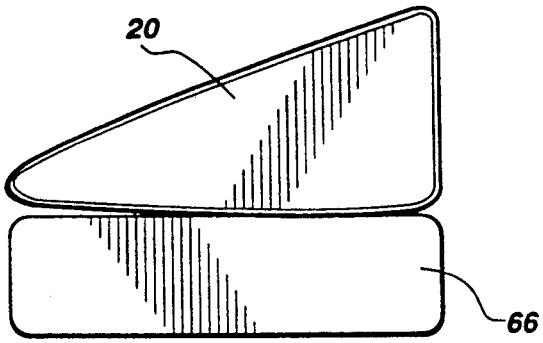
FIG. 15 is an isolated side elevational view of the bladder of FIG. 2A shown with a fixed volume pillow disposed beneath the bladder for adjusting the height of the inflatable bladder.

FIG. 15 illustrates how the height at which an inflatable bladder 20 operates may be varied by use of a non oscillating pillow 66. The height at which the exercise is accomplished may be varied according to need and desire to provide maximum benefits to the patient.

Figure 16:
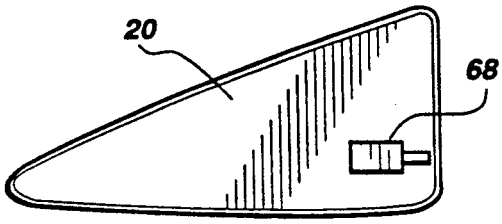
FIG. 16 is an isolated side elevational view of the bladder of FIG. 2A shown with a volume switch in replacement of a pressure switch.

FIG. 16 illustrates a position or Volume sensor 68 which optionally may be used in place of any of the pressure sensors discussed above. Volume sensor 68 is attached to the surface of the inflatable bladder 20, either on the inside or outside thereof. Changes in position or volume are detected by the sensor 68 which then sends a signal to an appropriate valve, as described above, to change the direction of the stream of air provided thereby.

While the invention has been described and illustrated in conjunction with the best currently known embodiments, it will be obvious to those skilled in the art that modifications and variations may be made in it without departing from the spirit of the invention as disclosed and the scope thereof as set forth in the following claims.

We claim:

1. A method of cyclically extending and collapsing an inflatable bladder under the weight of a patient's limb disposed adjacent the bladder for therapeutic purposes comprising the steps of:

coupling a gas feedline to the inflatable bladder;

directing a stream of gas through the gas feedline into the bladder to generate pressure in the inflatable bladder, thereby inflating the bladder and moving the patient's limb in a first direction;

coupling pressure sensitive switching means in line with the gas feedline;

continuously sensing the pressure of the bladder;

reversing the stream of gas when a predetermined pressure is sensed and thereby deflating the inflatable bladder and moving the patient's limb in a second direction without respect to time.

2. A method of cyclically extending and collapsing an inflatable bladder according to claim 1, wherein the predetermined pressure does not exceed 30 millimeters of mercury.

3. A method of cyclically extending and collapsing an inflatable bladder according to claim 1, wherein the pressure sensitive switching means is an electrically controlled pressure sensor coupled to and controlling an electrically operated valve which switches the direction of the stream of gas upon receiving an electrical signal from the pressure sensor.

4. A method of cyclically extending and collapsing an inflatable bladder according to claim 1, wherein the pressure sensitive switching means is a mechanically controlled pressure sensor coupled to and controlling a mechanically operated valve which switches the direction of the stream of gas upon receiving a signal from the pressure sensor.

5. An inflatable orthopedic pillow for therapy of a patient's extremity comprising an inflatable bladder for supporting the patient's extremity;

air supply means for providing a constant stream of air to the bladder;

an inlet conduit connecting the air supply means to the inflatable bladder for the passage of air from the air supply means to the bladder;

an air switch disposed on said inlet conduit in fluid communication with the bladder, the air switch including an atmospheric pressure inlet intersecting the inlet conduit, a return conduit connecting the bladder to the inlet conduit and intersecting the inlet conduit approximately opposite the intersection of the atmospheric inlet with the inlet conduit and through which overflow air is returned from the bladder to the air switch when a predetermined bladder pressure level is reached, and an exhaust outlet leading from the inlet conduit at a point adjacent the intersections of the atmospheric inlet and the return conduit to the inlet conduit;

whereby the inflatable bladder is cyclically inflated and deflated by the air switch and air supply means without outside control means, said air switch being operable to generate a repeating cycle beginning with inflation of the bladder by directing a stream of air provided by the air supply means through the air switch into the bladder until the bladder is inflated, and said cycle ending with deflation of the bladder by directing an overflow stream of air from the inflated bladder into the return conduit to be returned to the air switch, whereupon said stream of air provided by the air supply means is diverted into the exhaust outlet by the overflow stream of air and by air thereafter forced out of the bladder by negative air pressure.

6. An inflatable orthopedic pillow for therapy as in claim 5 further comprising means for rotating the patient's extremity as the inflatable bladder is cyclically inflated and deflated in a substantially perpendicular direction to the inflation and deflation of the bladder.

7. An inflatable orthopedic pillow for therapy as in claim 6 wherein the means for rotating the patient's extremity comprises a harness attachable to the patient's extremity which is attached at an attachment point on the inflatable bladder by a nonflexing cord.

8. An inflatable orthopedic pillow for therapy as in claim 5 further comprising means for preventing slippage of the patient's extremity during the cyclical inflation and deflation period.

9. An inflatable orthopedic pillow for therapy as in claim 8 wherein the means for preventing slippage of the patient's extremity is corresponding VELCRO TM fasteners, one of which is secured to the bladder and the other of which is fastened to the patient's extremity to be exercised.

10. An inflatable orthopedic pillow for therapy as in claim 5 wherein the bladder includes at least one reinforcing septum to assist in maintaining a desired shape of the bladder, each septum being constructed of a nonelastic, nonexpanding material and attached to opposing walls of the bladder.

11. An inflatable orthopedic pillow for therapy of a patient's extremity comprising:

an inflatable bladder for supporting and moving the patient's extremity;

air supply means for providing a constant stream of air to the inflatable bladder;

pressure sensor for measuring pressure which sends a signal when pressure within the inflatable bladder reaches a predetermined level; and means for reversing the inflation effect of the constant stream of air, said means being responsive to the signal sent by the pressure sensor.

12. An inflatable orthopedic pillow for therapy of a patient's extremity according to claim 11, wherein the signal sent by the pressure sensor is an electrical signal and the means for reversing the direction of the constant stream of air includes means for detecting and reading said electrical signal sent by the pressure sensor.

13. An inflatable orthopedic pillow for therapy of a patient's extremity according to claim 11, wherein the signal sent by the pressure sensor is a mechanical signal and the means for reversing the direction of the constant stream of air includes means for detecting and reading said mechanical signal sent by the pressure sensor.

14. An inflatable orthopedic pillow for therapy of a patient's extremity according to claim 11, wherein the means for reversing the direction of the constant stream of air is a valve which temporarily blocks the constant stream of air from the inflatable bladder.

15. The method of claim 1 wherein the step of coupling a pressure sensitive switching means in line with the gas feedline includes allowing a portion of the gas from the bladder to return through a return line separate from the feedline, under a pressure corresponding to the bladder pressure to the gas feedline, the gas in the return line intersecting the stream of gas flowing through the feedline, and further providing an exhaust path for the gas from the feedline, separate from the feedline and originating near the intersection of the return line with the feedline and substantially opposite thereto, whereby when the bladder pressure increases to a predetermined level, the gas in the return line diverts the stream of gas in the feedline to the exhaust path, thereby also diverting the gas in the bladder to the exhaust path through Venturi suction.

16. The method of claim 15 wherein the step of coupling a pressure sensitive switching means in line with the gas feedline further includes providing a path for gas of atmospheric pressure to intersect the feedline substantially opposite the intersection of the return line with the feedline, whereby when the bladder pressure decreases to a predetermined level, correspondingly decreasing the pressure in the return line, the atmospheric pressure gas diverts the stream of gas from the exhaust path to the feedline and forces gas into the bladder.

17. A method of moving and exercising a body extremity by cyclically extending and collapsing an inflatable bladder under the weight of a patient's limb, said method comprising the steps of:

coupling a gas feedline to the inflatable bladder;

directing a stream of gas through the gas feedline into the bladder to inflate the bladder to a predetermined threshold pressure of safe extension, said predetermined threshold pressure being cumulative of the combined pressure effects of the stream of gas within the gas feedline and the weight and movement of the patient's limb against the bladder which is transferred to the stream of gas;

sensing when the cumulative pressure within the inflatable bladder has reached the predetermined threshold pressure; and deflating the bladder to cause it to collapse.

* * * * *